United States Patent [19]

Hiscott

[11] 4,004,485

[45] Jan. 25, 1977

[54] MECHANISM FOR ADJUSTING TENSION OF AN ELONGATED FILAMENT

[75] Inventor: Rolly R. Hiscott, Costa Mesa, Calif.

[73] Assignee: Ernie Ball, Inc., Newport Beach, Calif.

[22] Filed: Aug. 11, 1975

[21] Appl. No.: 603,261

[52] U.S. Cl. ..... 84/207; 84/304

[51] Int. Cl.[2] ..... G10C 3/10; G10D 3/14

[58] Field of Search ..... 84/200, 202–207, 84/304–306, 297 R, 312

[56] References Cited

UNITED STATES PATENTS

| | | | |
|---|---|---|---|
| 614,735 | 11/1898 | Lyon | 84/207 |
| 806,949 | 12/1905 | Braun | 84/207 |
| 2,458,263 | 1/1949 | Harlin | 84/207 X |
| 3,452,635 | 7/1969 | Sebers et al. | 84/306 |

FOREIGN PATENTS OR APPLICATIONS

| | | | |
|---|---|---|---|
| 130,589 | 5/1902 | Germany | 84/202 |

*Primary Examiner*—Lawrence R. Franklin
*Attorney, Agent, or Firm*—Raymond L. Madsen

[57] ABSTRACT

There is disclosed a device for adjusting tension of an elongated filament having one end thereof coupled to a supporting structure, the device having a lever arm adapted to be pivotally attached to the supporting structure, a tuning peg having ratchet notches therein and being rotatably attached to the lever arm and being adapted to engage and adjustably wind the elongated filament therearound, a spring stop attached to the lever arm for engaging the ratchet notches of the tuning peg and an adjusting screw attached to the supporting structure and engaging the lever arm for pivotally positioning the lever arm with respect to the supporting structure whereby the tension of the elongated filament is coarsely adjusted by rotating the tuning peg and finely adjusted by pivoting the lever arm.

5 Claims, 3 Drawing Figures

MECHANISM FOR ADJUSTING TENSION OF AN ELONGATED FILAMENT

The present invention relates to mechanical devices for adjusting the tension of an elongated filament and more particularly to a combined coarse and fine tuning mechanism for adjusting the pitch of a string on a stringed musical instrument.

In the field of stringed musical instruments, it has been the general practice to employ tuning pegs to perform the adjustment of pitch of the strings of the stringed musical instrument. By engaging each string in winding engagement with a tuning peg, the tension of each string is adjusted by rotating the tuning peg associated therewith and winding the string therearound until the desired pitch is obtained. Although such devices have served the purpose, they have not proved entirely satisfactory under all conditions of operation for the reason that considerable difficulty has been experienced in finely adjusting the tension of the string because of difficulty in positioning and holding the tuning peg in a particular desired position to achieve the desired tension. To overcome this problem, U.S. Pat. No. 3,407,696, granted to Jimmy G. Smith, et al., employs a ring-like structure mounted on an axis or pivot rod with the lever arm extending from the ring. A diagonal bore is made through the lever arm at an angle and a string of the stringed instrument is drawn over the periphery of the ring-like structure and through the bore. A locking screw is provided through the bore to hold the string tightly therein. A tuning screw in a fixed assembly presses downward on the lever arm placing tension on the string. Adjustment of the tuning screw increases or relaxes the tension on the string to set the tuning of the string. In order to pretension the string before the locking screw is tightened to clamp the string tightly in the bore, a pretensioning mechanism is utilized in which there is a slot through which the string to be tuned is inserted and while manually being held as tightly as possible, a knob associated with the tensioning mechanism is rotated to wind the string up tightly on the tensioning mechanism close to the desired pitch. At this point, the locking screw in the bore is tightened against the string thereby cinching it down tightly and fixedly in the bore from which it cannot slide. Although the mechanism of U.S. Pat. No. 3,407,696 has served its purpose, it has not proved entirely satisfactory under all conditions of service for the reason that considerable difficulty is experienced in manually stretching each string and in adjusting the tensioning mechanism to stretch a plurality of strings inserted therein to adjust the tension of each string close to a desired pitch.

Those concerned with the development of tuning mechanisms for stringed instruments have long recognized the need for an individual coarse and fine tuning adjustment for each string of a multiple stringed musical instrument. The present invention fulfills this need.

One of the most critical problems confronting designers of stringed musical instruments has been the development of an individually adjustable fine and coarse tuning for each string, which problem is overcome by the present invention.

The general purpose of this invention is to provide a coarse and fine tuning mechanism for each string of a stringed musical instrument which embraces all the advantages of similarly employed tuning pegs and tuning levers and possesses none of the aforedescribed disadvantages. To attain this, the present invention contemplates a unique ratchet tuning peg and stop arrangement rotatably mounted in a pivotal tuning arm whereby coarse tuning is provided by the ratchet tuning peg and fine tuning by the pivotal tuning arm.

An object of the present invention is the provision of a combined coarse and fine tuning mechanism for adjusting the tension of an elongated filament.

Another object is to provide a combined coarse and fine pitch adjusting mechanism for tuning each string of a stringed musical instrument.

Still another object is to provide a coarse ratchet tuning adjustment on the rotating tuning arm of a stringed musical instrument.

Yet another object of the present invention is the provision of a rotating surface over which the string attached to a tuning lever is stretched and which moves with the string as the tension of the string is adjusted.

A still further object of the present invention is the provision of a threaded nut in slidable engagement with the tuning arm which nut is threaded on a rotating tuning screw rotatably and fixedly mounted in a supporting structure for providing a sliding bearing surface between the nut and the tuning arm of a stringed musical instrument.

Other objects and many of the attendant advantages of this invention will be readily appreciated as the same becomes better understood by reference to the following detailed description when considered in connection with the accompanying drawings in which like reference numerals designate like parts throughout the figures thereof, and wherein.

Figure 1:
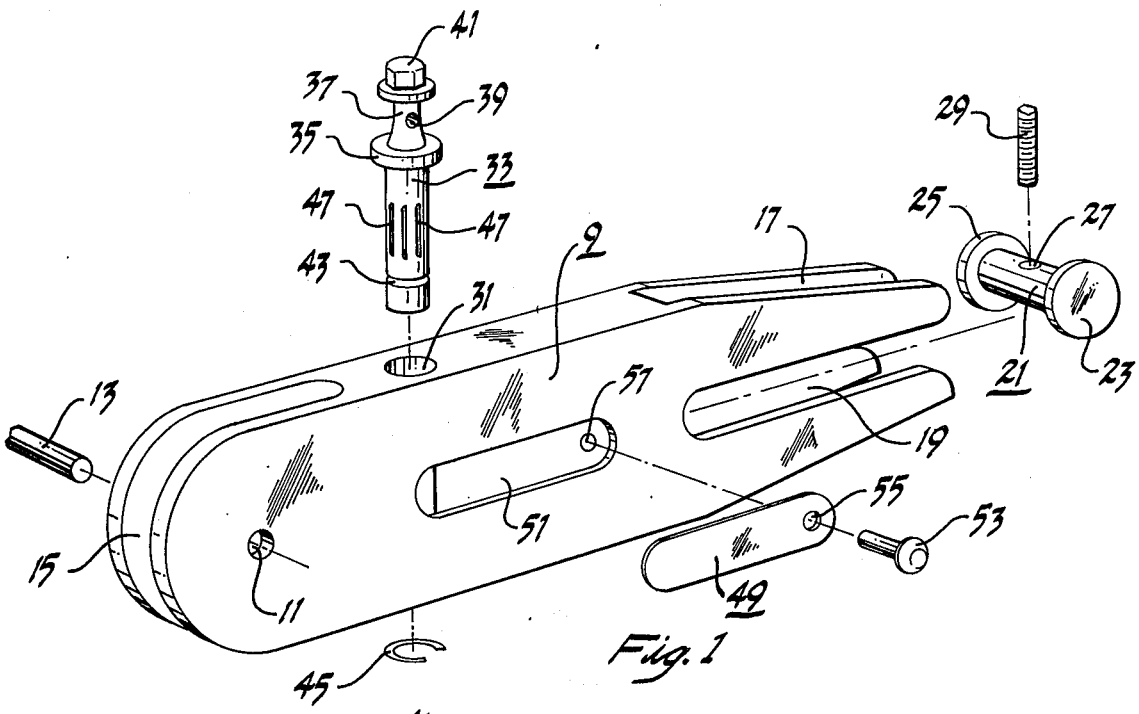
FIG. 1 shows an exploded perspective view of a preferred embodiment of the invention.

Referring now to the drawings, wherein like reference characters designate like or corresponding parts throughout the several views, there is shown in FIG. 1 (which illustrates a preferred embodiment) a tuning lever or tuning arm 9 having a pivot shaft or opening 11 through one end thereof to receive a pivot shaft or axle 13 therein. A groove 15 is arcuately disposed in the surface of lever arm 9 about pivot shaft opening 11. The other end of lever arm 9 has longitudinal slots 17 and 19 disposed therein, the slots being formed at right angles to one another. Longitudinal slot 19 slidably engages cylindrical or spool nut 21 which has collars 23 and 25 on the end surfaces thereof to keep nut 21 centered about its cylindrical axis in slot 19. Cylindrical nut 21 has threaded hole 27 therethrough along a diameter thereof which threadably engages tuning or adjusting screw 29, adjusting screw 29 extending through slot 17 when cylindrical nut 21 is slidably engaged in slot 19.

Lever arm or tuning arm 9 further has cylindrical hole 31 therethrough in which tuning peg 33 is rotatably mounted. Tuning peg 33 has a collar 35 to which spool 37 is integrally connected. Spool 37 has hole 39 therethrough for accepting the end of an elongated filament. Spool 37 has a bolt head 41, which may be a hex bolt head, attached thereto adapted to be engaged by a wrench. The other end of tuning peg 33 has a peripheral slot 43 therearound into which C-clip 45 is inserted to hold tuning peg 33 in rotatable engagement in cylindrical opening 31 of tuning lever 9. Tuning peg 33 has longitudinal slots or ratchet notches 47 centrally located therearound.

Tuning arm 9 has an opening or recess 51 in the side thereof which intersects a portion of cylindrical opening 31 therein. A stop or flat spring or spring click 49 is inserted into recess or opening 51 and is held therein by rivet 53 inserted through hole 55 in flat spring click 49 and which in turn engages and passes through opening 57 in tuning arm 9 to hold flat spring click 49 in fixed engagement with tuning arm 9. Flat spring click 49 engages notches 47 to permit rotation of tuning peg 33 in one direction only.

Figure 2:
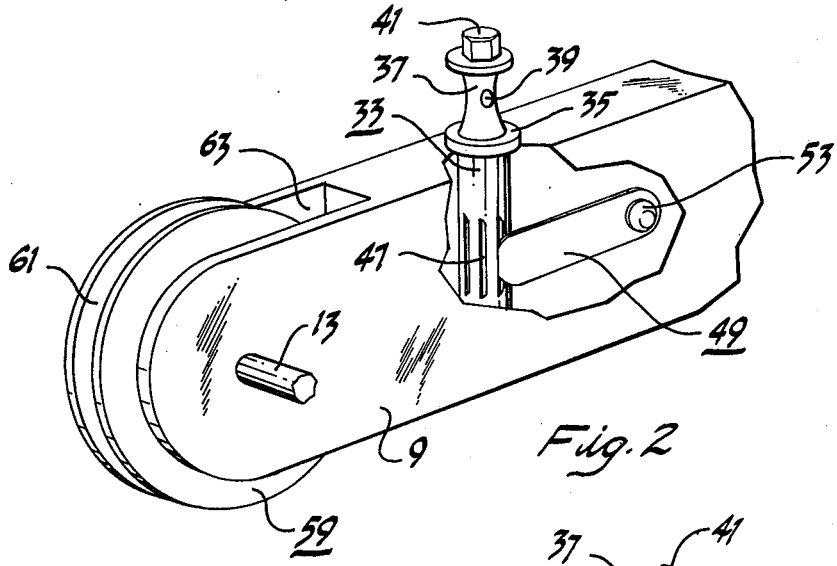
FIG. 2 illustrates a perspective view of a portion of another embodiment of the invention, partly cut away, having a rotating pulley wheel surface over which a string is stretched and tensioned.

An alternate form of the tuning mechanism is illustrated in FIG. 2 where rotating pulley wheel 59 having a groove or depression circumferentially therearound is rotatably mounted on pivot rod or shaft 13 within slot 63 formed in the end of tuning arm 9.

FIG. 2 further illustrates tuning peg 33 mounted in tuning arm 9, a portion of tuning arm being cut-away to show flat spring click 49 in engagement with an elongated or ratchet slot 47 of tuning peg 33. Tuning peg 33 has collar 35 in rotating engagement with the surface of tuning arm 9 with spool 37 extending outwardly therefrom to windingly engage the end of an elongated filament stretched through groove 61 of pulley wheel 59.

Figure 3:
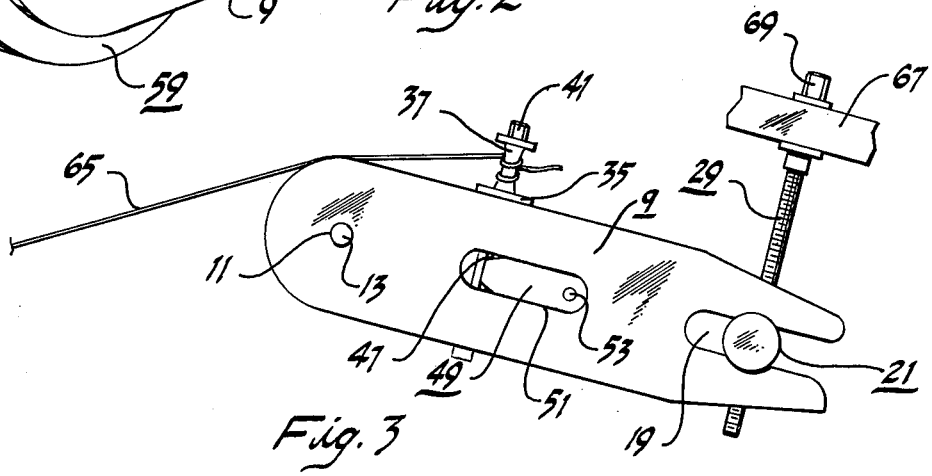
FIG. 3 illustrates a side elevation of the assembled apparatus shown in FIG. 1.

FIG. 3 illustrates a side elevation of the assembled apparatus showing elongated filament or string 65 stretched around the end of tuning lever 9 and windingly engaged around spool 37 of the tuning peg. Pivot rod or axle 13 engages pivot shaft or bearing shaft 11 at one end of tuning arm 9 and cylindrical nut 21 is slidably engaged in slot 19 at the other end of tuning arm 9, nut 21 being further threadably engaged by tuning screw 29 which is rotatably mounted in support structure (which may be a portion of a musical instrument) 67. The end of tuning screw or fine adjusting screw 29 extending through support structure 67 has a multifaceted or hex bolt head 69 thereon adapted to be engaged by a wrench. Adjusting screw 29 may be held in support structure 67 by a C-clip similar to C-clip 45. Rivet 53 holds spring click 49 in cutout of void 51 in the side of tuning lever 9. Spring click 49 further engages longitudinal or ratchet slot 47 in the tuning peg.

Operation of the invention can best be described by referring to FIG. 3. Elongated filament or string 65 is stretched across groove 15 of FIG. 1 or groove 61 of pulley wheel 59 in the end of tuning lever 9 and wound around spool 37 of tuning peg 33 by inserting the end of the string or filament in hole 39 (not illustrated) in spool 37. A wrench may be used to engage bolt head 41 to rotate tuning peg 33 winding the filament or string around spool 37. As tuning peg 33 is rotated, flat spring click 49 engages longitudinal or ratchet slots 47 in tuning peg 33 to prevent the string or filament from unwinding from spool 37 and allowing tuning peg 33 to be rotated in one direction only. The tension of string or filament 65 is coarsely adjusted to near the desired tension or pitch by rotation of tuning peg 33. Once the string or filament is coarsely adjusted in tension or pitch, then adjusting or tuning screw 29 is rotated causing cylindrical nut 21 to move along the threads of tuning screw 29 and to pivot tuning arm 9 about pivot rod 13 as nut 21 moves in slidable engagement in slot 19. Tuning screw 29 is rotated by a wrench engaging bolt head 69. It should be noted that the sliding engagement of bolt 21 in slot 19 prevents grooves or worn spots from developing in lever arm 9 typical of prior art devices where the point or tip of the tuning screw is in engagement with a surface of the lever arm such as illustrated in U.S. Pat. No. 3,407,696. Since the ratchet adjustment of tuning peg 33 allows only fixed steps of rotation, the winding of the string around spool 37 of tuning peg 33 permits only a coarse adjustment of the tension of the string or filament. The fine tuning is accomplished by the continuous threaded advancement or retraction of nut 21 longitudinally along adjusting screw 29. Therefore, depending upon the length of arm 9 and the pitch of the threads of adjusting screw 29, precision tuning or tensioning of string or filament 65 can be achieved.

It now should be apparent that the present invention provides a mechanical tuning arrangement which may be employed in conjunction with a stringed musical instrument for providing a coarse and fine adjustment of each string thereon to a tuning lever having a ratchet tuning peg rotatably mounted therein.

Although particular components, etc., have been discussed in connection with a specific embodiment of a combined coarse and fine tuning mechanism constructed in accordance with the teachings of the present invention, others may be utilized. Furthermore, it will be understood that although an exemplary embodiment of the present invention has been disclosed and discussed, other applications and circuit arrangements are possible and that the embodiments disclosed may be subjected to various changes, modifications and substitutions witout necessarily departing from the spirit of the invention.

What is claimed is:

1. A device for adjusting tension of an elongated filament of which one end thereof is coupled to a supporting structure comprising:

a lever having an opening through one end thereof adapted to be receive and rotate about a pivot shaft fixedly attached to the supporting structure adjacent the other end of the elongated filament, said lever arm having a cylindrical hole therethrough adapted to receive a tuning peg and having a recess adjacent to and intersecting said cylindrical hole;

a tuning peg having ratchet notches spaced longitudinally therearound and being rotatably mounted in said cylindrical hole in said lever arm, said tuning peg being adapted to engage and adjustably wind the other end of the elongated filament therearound as said tuning peg is rotated;

a flat spring member attached to said lever arm and extending into said recess to contact and engage said ratchet notches of said tuning peg to allow said tuning peg to rotate in one direction and to prevent the elongated filament from unwinding therefrom, whereby the tension of the elongated filament may be coarsely adjusted by rotating said tuning peg; and adjusting means attached to the supporting structure and engaging the other end of said lever arm for rotatably position said lever arm with respect to the supporting structure to finely adjust the tension of the elongated filament.

2. The device for adjusting tension of an elongated filament described in claim 1 wherein said lever arm further includes slots in the other end thereof and wherein said means attached to the supporting structure and engaging said lever arm comprises:

an adjusting screw rotatably engaged in the supporting structure; and a nut slidably engaged in said slots of said lever arm and threadably engaged by said adjusting screw.

3. The device for adjusting tension of an elongated filament described in claim 2 further including a groove in the surface of said lever arm arcuately located around the pivot point of said lever arm to receive and guide the elongated filament as said tuning peg is rotated and as said lever arm is pivoted.

4. The device for adjusting tension of an elongated filament described in claim 2 further including:

a slot in the pivot end of said lever arm, said slot adapted to receive a pulley wheel; and a pulley wheel for insertion into said slot in said pivot end of said lever arm, said pulley wheel being adapted to be rotatably attached to the supporting structure on the pivot axis of said lever arm and to receive and guide the elongated filament as the tuning peg is rotated and as said lever arm is pivoted.

5. A coarse and fine tuning mechanism for a stringed musical instrument, comprising:

a tuning arm having a pivot shaft opening through one end thereof adapted to receive and rotate about a pivot shaft fixedly attached to the stringed musical instrument, said tuning arm having an arcuate groove in said one end with a radius centered on the axis of said pivot shaft opening for receiving and guiding a string of the stringed musical instrument over said one end, said tuning arm having longitudinal slots in the other end thereof adapted to receive a tuning nut in slidable engagement therein, said tuning arm having a cylindrical hole therethrough adapted to receive a tuning peg therein and having a recess adjacent to and intersecting said cylindrical hole, said recess adapted to receive a flat spring click;

a tuning peg rotatably mounted in said hole in said tuning arm, said tuning peg having longitudinal slots therearound adapted to receive and engage the end of a flat spring click and having a spool on one end with a hole therethrough adapted to receive a string of the stringed musical instrument in winding engagement therewith;

a flat spring click located in said recess in said tuning arm and having one end thereof fastened to said tuning arm, the other end thereof being in flexible engagement with said slots in said tuning peg to allow said tuning peg to rotate in one direction only whereby the string of the stringed musical instrument is wound on said spool of said tuning peg to coarsely tune the musical pitch of the string;

a tuning nut slidably engaged in said slots of said tuning arm, said nut having a threaded opening therethrough adapted to engage the threads of a tuning screw; and;

a tuning screw rotatably mounted on said stringed musical instrument, said adjusting screw being in threaded engagement with said nut to move said nut longitudinally along said tuning screw as said tuning screw is rotated, thereby rotating said tuning arm about the axis of said pivot shaft opening as said adjusting screw is turned, finely tuning the musical pitch of the string wound on said tuning peg.

* * * * *